US009902533B2

(12) United States Patent
Meyers et al.

(10) Patent No.: US 9,902,533 B2
(45) Date of Patent: Feb. 27, 2018

(54) LID FOR A CONTAINER

(71) Applicant: RUNWAY BLUE, LLC, Lehi, UT (US)

(72) Inventors: David O. Meyers, East Layton, UT (US); Steven M. Sorensen, Alpine, UT (US)

(73) Assignee: RUNWAY BLUE, LLC, Alpine, UT (US)

( * ) Notice: Subject to any disclaimer, the term of this patent is extended or adjusted under 35 U.S.C. 154(b) by 0 days.

(21) Appl. No.: 14/645,201

(22) Filed: Mar. 11, 2015

(65) Prior Publication Data

US 2016/0264320 A1 Sep. 15, 2016

(51) Int. Cl.

*B65D 47/06* (2006.01)
*B65D 47/08* (2006.01)
*B65D 45/02* (2006.01)

(52) U.S. Cl.

CPC ..... *B65D 47/0866* (2013.01); *B65D 45/025* (2013.01); *B65D 2251/1075* (2013.01)

(58) Field of Classification Search

CPC B65D 43/265; B65D 45/025; B65D 47/0866; B65D 2251/1075
USPC ..... 222/153.09, 153.1, 517, 536, 556; 220/254.5, 264, 326
See application file for complete search history.

(56) References Cited

U.S. PATENT DOCUMENTS 2,272,867 A * 2/1942 Cobel ..... B65D 45/025 222/473
2,378,451 A * 6/1945 Vensel ..... B65D 47/0866 222/556
D206,345 S 11/1966 Kelly
3,853,250 A * 12/1974 Alpern ..... B65D 47/0866 222/517
4,203,529 A * 5/1980 Torassa ..... B65D 45/025 220/264
4,776,501 A * 10/1988 Ostrowsky ..... B65D 47/2006 215/235

(Continued)

FOREIGN PATENT DOCUMENTS

EP 0714834 A1 * 6/1996 ..... B65D 47/0866
EP 1127801 A1 * 8/2001 ..... A47J 41/0027

(Continued)

OTHER PUBLICATIONS

International Search Report and Written Opinion from PCT international application No. PCT/US2015/059683, dated Apr. 25, 2016.

(Continued)

*Primary Examiner* — Nicholas J Weiss
(74) *Attorney, Agent, or Firm* — Maschoff Brennan

(57) ABSTRACT

A lid may include a lower portion and an upper portion that is pivotally attached to the lower portion. The lid may also include a locking member coupled to a bottom surface of the upper portion of the lid. The locking member may be slidable between a locked and an unlocked position. When the locking member is in the locked position, the upper portion of the lid may be pivotally coupled to the lower portion of the lid and movable between an open position that allows the one or more fluids to be poured from the container and a closed position that prevents the one or more fluids from being poured from the container.

24 Claims, 8 Drawing Sheets

(56) References Cited

U.S. PATENT DOCUMENTS

| | | | | |
|---|---|---|---|---|
| 5,205,424 | A * | 4/1993 | Gaspar | B65D 83/0481 215/210 |
| 5,284,264 | A * | 2/1994 | Gross | B65D 55/02 215/206 |
| 5,894,965 | A * | 4/1999 | Robbins, III | G01F 11/263 222/444 |
| D453,446 | S | 2/2002 | Bodum | |
| D657,629 | S | 4/2012 | Olson | |
| D667,694 | S | 9/2012 | Meyers | |
| 8,286,813 | B2 * | 10/2012 | Eklund | B65D 47/268 215/235 |
| D676,280 | S | 2/2013 | Wong | |
| D715,655 | S | 10/2014 | Brewer | |
| D721,972 | S | 2/2015 | Brewer | |
| D722,272 | S | 2/2015 | Brewer | |
| D723,930 | S | 3/2015 | Brewer | |
| D736,563 | S | 8/2015 | George | |
| D758,869 | S | 6/2016 | Blake | |
| D763,622 | S | 8/2016 | Shirley | |
| 2013/0062351 | A1 * | 3/2013 | Meyers | B65D 47/0885 220/324 |

FOREIGN PATENT DOCUMENTS

| | | |
|---|---|---|
| JP | 1391631 | 7/2010 |
| KR | 3007332160000 | 3/2014 |
| KR | 30-0733216-1 | 6/2014 |

OTHER PUBLICATIONS

U.S. Appl. No. 29/520,164, filed Mar. 11, 2015, Meyers, et al.
Office Action from U.S. Appl. No. 29/520,164, dated Sep. 27, 2016.

* cited by examiner

LID FOR A CONTAINER

BACKGROUND

Field of the Invention

The present invention generally relates to lids and, in particular, to lids for containers.

Description of Related Art

Conventional containers may hold a variety of different types of liquids and fluids. In some instances, conventional containers may hold fluids that require mixing. For example, conventional containers may hold powdered drinks, electrolyte pills, energy drinks, baby formulas, pancake batters, crepe mixes, baking materials, dietary supplements, salsa, sauces, oil and vinegar, salad dressings, smoothies, juices, coffee and creamer, medicinal products, non-edible materials (e.g., paint, household cleaners), and the like. These known containers may hold fluids composed of various ingredients, which may include liquids and/or solids, and may be designed to mix the ingredients to form a substantially uniform mixture.

Known containers may be used for mixing ingredients in a wide variety of environments such as at home, office, gym or health club, and while traveling. Known containers may also be used for mixing ingredients during activities such as exercising, driving a car, or riding in an automobile, bus, train, or airplane.

Some known containers may include a body or vessel for holding a fluid and a lid to prevent the fluid from spilling. The lid, however, may include grooves or crevices in which particles or materials may get stuck or caught while mixing or dispensing of the fluid. Also, the lid may be difficult to clean or reuse because of the shape, number of parts, complex configuration, and interconnection of the components.

In addition, known containers may be difficult or inconvenient to use for mixing and dispensing ingredients of relatively large sizes because the opening may not be sufficiently large. For example, the opening of some conventional containers may not be appropriately sized to allow large ingredients to exit the container upon dispensing. For example, some ingredients may get caught in the opening because the opening is too small.

Additionally, some known containers may require shaking to mix ingredients within the container and, in order to prevent contents from leaking out of the container when shaking, the lid may be secured in a manner that makes it difficult and time consuming to open to dispense the contents of the container. For example, the lid may be screwed on the container and the user may have to unscrew the lid to dispense the contents, which may be especially difficult for users with limited dexterity.

Furthermore, some known containers may include a cover over an opening in the lid to prevent the contents from leaking out of the opening. These known containers may not prevent contents from leaking when shaking the container.

BRIEF SUMMARY OF THE INVENTION

A need therefore exists for an apparatus or device that eliminates the above-described disadvantages and problems.

One aspect is a container that may be sized and configured to be filled with a wide variety of fluids. For example, the container could hold one or more liquids, beverages, drinks, juices, vitamin-enhanced beverages, energy drinks, thirst-quenchers, flavored waters, and the like. The container could also hold various powders, mixtures, and/or solutions, which could include vitamins, supplements, powdered drinks, electrolyte pills, protein powders, medicinal products, baby formulas, etc. The container could hold solids and/or other types of materials including foodstuffs such as fruits, vegetables, soups, dressings, sauces, batters, baking materials, and the like. The container could further hold non-edible fluids, which could include paint, household cleaners, etc.

Another aspect is a container that may allow the contents to be stirred, shaken, mixed, and/or blended as desired. This may allow protein drinks, shakes, smoothies, dressings, sauces, etc. to be created and/or stored within the container. Advantageously, the container may be reusable and refillable, which may allow the container to be used for many different purposes over an extended period of time. The container may also be easily carried and portable. For example, the container may be conveniently held in one-hand by the user. Also, the inside surfaces of the container may be smooth and at least substantially without grooves, crevices, and the like to prevent items, particles, or materials from getting caught during mixing and/or dispensing of the contents from the container. Additionally, if desired, the container may be insulated to help keep the contents at a desired temperature, such as at a lower or higher temperature. Advantageously, the container may include a small number of parts and components, which may facilitate manufacturing and assembly. Furthermore, the container may include measurement markings to facilitate measuring and dispensing of the contents of the container.

Still another aspect is a lid that may be coupled to a container. If desired, the lid may be easily attached and/or detached from the container, which may allow the lid and container to be easily cleaned. The lid may also allow the container to be easily filled from various sources. Significantly, the lid may be connected to containers of different types, sizes, and configurations, depending, for example, upon the intended use of the container. In addition, the lid may be used or sold with a container, and the lid and container may be independently used or sold.

Yet another aspect is a lid that may be constructed from plastic, metal, a combination of plastic and metal, or other materials with suitable characteristics and properties. The lid may be attached to containers made from plastic, glass, metal, and the like. Advantageously, the lid may be constructed from relatively few parts and the lid may be quickly and efficiently manufactured. For example, the lid may include an upper portion, a lower portion, a locking member, and a flexible member such as a biasing member. Advantageously, the lid may be constructed from parts that may be easily disassembled to be cleaned and washed. For example, the lower portion of the lid may be selectively attached to a container and the upper portion of the lid may be selectively attached to the lower portion. A bottom surface of the lid that covers the opening to the container may be relatively smooth and substantially without grooves, crevices, which may help prevent items, particles or materials from getting caught during mixing and/or dispensing of the contents from the container. One of ordinary skill in the art, after reviewing this disclosure, will appreciate that the lid could include any suitable number of parts and components, and the lid could have other appropriate shapes, sizes, configurations and arrangements depending, for example, upon the intended use of the container.

Still yet another aspect is a lid that is preferably easily attached and removed from the container. For example, the lower portion of the lid may be easily attached and removed from the container. In particular, the lower portion of the lid may be selectively attached to the container by a threaded or screw-type connection, which may allow the lid to be quickly secured to the container in a straightforward manner. If desired, a gasket, washer, sealing ring, liner or the like may be disposed between the lid and the container. The lid may also be attached to the container with a fluid or water-tight seal, which may help prevent the contents from leaking or spilling. The lid may cover a relatively large opening to allow the container to be easily filled, cleaned, and washed. While the lid is preferably selectively attached to the container, the lid could be permanently attached to the container.

A further aspect is a lid that may include a spout and the spout may provide a direct opening to the container. The spout may be sized and configured to allow a user to pour from the container. The spout may also be large enough to allow the contents to easily be poured or dispensed and the spout may have numerous shapes such as circular, oval, round, oblong, curved, semicircular, arc, rectangular, square, polygonal, and the like. The spout may be disposed toward or in a periphery or outer edge of a lower portion of the lid, or other desired portion of the lid. In an exemplary embodiment, the spout may extend generally outwardly and/or upwardly from a lower portion of the lid. In another exemplary embodiment, the spout may be at least partially formed by or disposed at least proximate an outer sidewall of the lower portion of the lid. Advantageously, the spout may be integrally formed with the outer sidewall of the lower portion of the lid, which may improve the strength and structural integrity of the spout. The spout may include a lip that may have numerous shapes such as curved, V-shaped, semicircular, arc, rectangular, square, polygonal, and the like. In an exemplary embodiment, the lip of the spout may project outwardly from an upper rim of the lower portion of the lid. It will be appreciated after reviewing this disclosure that the spout could have various shapes, sizes, configurations and arrangements depending, for example, upon the intended use of the container. It will also be appreciated that the lid may include any suitable number of spouts, openings, and the like.

A still further aspect is a lid that may include an upper portion and a lower portion, and the upper and lower portions may provide easy, controlled access to the contents of the container. For instance, the lower portion of the lid may include a spout and the upper portion of the lid may act as a closure or cover that selectively allows or prevents fluid from exiting the container through the spout. For example, the upper portion of the lid may be pivotally coupled to the lower portion of the lid and may pivot between open and closed positions. When the upper portion of the lid is in the closed position, the upper portion may cover the spout and prevent fluid from exiting the container through the spout. When the upper portion of the lid is in the open position, the upper portion may uncover the spout and allow fluid to exit the container through the spout. When a user applies a force to the upper portion of the lid, the upper portion may act as a lever and may pivot around one or more pivot points between the open and closed positions. In more detail, a downward force on one side of the upper surface of the upper portion may move the upper portion to the open position and open the lid, while a downward force on an opposite side of the upper surface of the upper portion may move the upper portion to the closed position and close the lid. Because the upper portion may be pivotally coupled to the lower portion, this may provide a mechanical advantage so that a relatively small amount of force or pressure may be required to move the upper portion between the open and closed positions. Significantly, because the upper portion of the lid may be moved between the open and closed positions with relatively little force or pressure, this may allow the container to be used by a wide range of users. Advantageously, a user may be able to hold the container in one hand and use his or her thumb or finger on that hand to apply a force to move and/or maintain the upper portion of the lid in the open or closed positions. Thus, the upper portion of the lid may be simple and straightforward to use and operate. As explained in further detail below, the lid may include a flexible or biasing member. Advantageously, if the lid includes the flexible or biasing member, the user may not need to apply a force to move the upper portion from the open to the closed position because the lid may be biased into the closed position.

Yet another further aspect is a lid that may include a flexible or biasing member with spring-like qualities or aspects. For example, the flexible member may be constructed from an elastic, bendable, malleable, expandable, flexible, and/or resilient material, such as plastic and/or steel. In greater detail, the flexible member may be constructed from spring steel and in the form of a wire with a loop-shaped portion and an angled portion. The flexible member may be disposed between the upper and lower portions of the lid. In particular, the flexible member may be disposed between the locking member and the lower portion of the lid. For instance, one portion of the flexible member may be coupled to the locking member and another portion of the flexible member may contact or engage the lower portion of the lid. Specifically, the flexible member may include a downwardly extending portion that contacts or engages an upper surface of the lower portion of the lid. One of ordinary skill in the art will appreciate after reviewing this disclosure that the flexible member could be integrally formed with the upper and/or lower portions of the lid, or the locking member, and the flexible member could have other appropriate shapes, sizes, configurations and arrangements depending, for example, upon the intended use of the container.

Another aspect is a lid that may include a flexible member and at least a portion of the flexible member may be disposed within a guide. For example, the guide may be disposed in an upper surface of the lower portion of the lid and the guide may include a slot, groove, or the like. The guide may extend generally downwardly and may be integrally formed with the lower portion of the lid. In an exemplary embodiment, the guide may have a generally V-shaped configuration and a portion of the flexible member may be disposed within the guide. The flexible member may also move within the guide when the lid is opened or closed, and/or when the locking member moves between the locked and unlocked positions. Also, the flexible member may flex, bend, and/or compress when a force is applied to, for example, a rear portion of the upper portion of the lid, which may move the upper portion of the lid into the open position. Advantageously, when the force is removed, the flexible member may resiliently return to its former shape and/or length, and that may automatically close the lid. It will be understood, however, that the flexible member is not required.

Still another aspect is a lid that may include an upper portion that is preferably easily connected or coupled to a lower portion. For instance, the upper portion may be coupled to the lower portion by a locking member and the locking member may be easily locked and unlocked. The locking member may be connected or coupled to a bottom or lower surface of the upper portion of the lid in a manner that allows the locking member to slide or move with respect to the upper portion of the lid. For example, the locking member may be disposed within a receiving portion, which may be formed by one or more walls and/or guides, and the locking member may be movable within the receiving portion. If desired, the locking member may be selectively coupled to the upper portion of the lid, which may allow the locking member to be easily removed for cleaning. When the locking member is in the locked position, the upper portion of the lid may be pivotally coupled to the lower portion of the lid, and the upper portion of the lid may be movable between the open and closed positions. When the locking member is in the unlocked position, the upper portion of the lid may be uncoupled and removed from the lower portion of the lid. When the locking member moves between the locked and unlocked positions, it may slide along a path that is substantially parallel to the bottom of the upper portion of the lid. It will be understood that the locking member is not required and while the upper and lower portions of the lid are preferably selectively attached to each other using the locking member, the upper and lower portions could be permanently attached if desired.

Yet another aspect is the upper portion of the lid may be selectively coupled to the lower portion of the lid by one or more engaging portions and receiving portions. For example, the engaging portions may extend outwardly from a lower portion of the lid and the engaging portions may comprise portions, protrusions, projections, pins, knobs, and the like. The receiving portions may be disposed in the upper portion of the lid and the locking member, and the receiving portions may comprise openings, slots, apertures, depressions, indentations, detents, grooves, and the like. In an exemplary embodiment, the receiving portion of the upper portion of the lid may be a slot, the receiving portion of the locking member may be a groove, and the engaging portion of the lower portion of the lid may be a protrusion. The receiving portion of the upper portion of the lid may be aligned with the receiving portion of the locking member and the engaging portion may be disposed in the receiving portions. When the locking member is in the locked position, the engaging portion may be locked in the receiving portions to connect the upper and lower portions of the lid. When the locking member is in the unlocked position, the engaging member may be removed from the receiving portions of the upper portion of the lid and locking member, which may allow the upper portion of the lid to be easily removed from the lower portion. Thus, the locking member may selectively couple the upper and lower portions of the lid. Further, when the locking member is in the locked position, the engaging portions may act as a pivot point around which the upper portion of the lid may pivot between the open and closed positions. Thus, the upper portion of the lid may be selectively pivotally coupled to the lower portion of the lid by the locking member.

One of ordinary skill in the art, after reviewing this disclosure, will appreciate that the engaging portions and receiving portions of the lid could have other appropriate shapes, sizes, configurations, and arrangements. For example, the engaging portions may be disposed on the upper portion of the lid, while the receiving portions may be disposed on the lower portion of the lid. Also, the direction in which the locking member may move to enter the locked position may vary depending on the configuration and arrangement of the engaging portions and the receiving portions. For example, the locking member may move in a forwards or backwards direction into the locked position.

Still yet another aspect is a lid that may include a locking member with one or more gripping portions, such as flanges, protrusions, grooves, and the like, which may facilitate gripping of the locking member and movement of the locking member between the locked and unlocked positions. For example, an outer sidewall of the lower portion of the lid, which may extend around a circumference or perimeter of the lower portion of the lid, may include an aperture that allows a user to grip the gripping portion of the locking member. The aperture may be disposed generally beneath the gripping portion of the locking member and the aperture could have various shapes, sizes, and configurations. The width of the aperture may, for example, be generally equal to or at least as wide as the locking member. The user may insert his or her digit or digits into the aperture and move the locking member to the locked position by moving the locking member in one direction. The user may move the locking member in an opposite direction to unlock the locking member. For example, the user may insert his or her digit or digits into the aperture and move the locking member to the locked position by pulling the gripping portion of the locking member away from a spout. The user may insert his or her digit or digits into the aperture and move the locking member to the unlocked position by pushing the gripping portion of the locking member towards the spout. This may allow the locking member to be easily locked and unlocked, which may allow the upper and lower portions of the lid to be easily connected and disconnected.

A further aspect is a lid that may include one or more support walls. For example, the support walls may be at least substantially disposed within a circumference or outer perimeter of the lower portion of the lid. The support walls may extend upwardly from an upper surface of the lower portion of the lid to a height approximately equal to a height of the outer sidewall. The support walls may abut and/or support the upper portion of the lid and the support walls may be disposed generally perpendicular to the upper surface of the lower portion of the lid. The engaging portions or pivot points, which may facilitate connection of the upper and lower portions of the lid, may be generally aligned and disposed on opposing, upper surfaces of the support walls. In greater detail, the lower portion of the lid may include first and second inner support walls that are generally parallel to each other and a first pivot point may be disposed on the first support wall and a second pivot point may be disposed on the second support wall. The first and second pivot points may be generally aligned and disposed on opposing surfaces of the support walls. The locking member may include first and second receiving portions that are spaced apart by a distance that is approximately equal to a distance between the first and second pivot points. Similarly, the upper portion of the lid may include first and second receiving portions that may be spaced apart a distance approximately equal to a distance between the first and second pivot points. The first and second pivot points may be disposed in both the first and second receiving portions of the locking member and the upper portion of the lid. This may allow the upper portion of the lid to pivot about an axis of rotation that is generally aligned with both the first and second pivot points. The first and second pivot points may be disposed at a height approximately equal to a height of a spout, which may allow the upper portion of the lid to lay substantially flat across an opening of the spout when the upper portion is in a closed position.

A still further aspect is a lid that may include an upper portion sized and configured to selectively cover a spout to prevent leakage of contents from the container. When the lid is in a closed position, the upper portion may contact, engage and/or abut a lip of the spout. Specifically, a section of the upper portion of the lid may have a shape that generally corresponds to a shape of a lip of the spout and that section may seal the spout when the lid is in the closed position. Further, the upper portion of the lid may include a ridge or flange, which may be set back or spaced apart from the outer edge of the lid. The ridge may be substantially in the shape of the spout and may fit inside the spout when the lid is closed. In particular, when the lid is closed, the ridge may contact, engage and/or abut an inner circumference or portion of the spout to further secure contents inside the container and prevent leakage. In addition, when the lid is in the closed position, a force or other intentional act may be required to open the lid, which may help prevent an unintended opening of the container. Advantageously, the lid may allow the container to be quickly and easily closed to prevent the contents from leaking or spilling, which may facilitate mixing the contents of the container, such as, for example, by shaking.

Another aspect is a lid that may be sized and configured to be attached to a container, and the container may be sized and configured to be filled with one or more fluids. The lid may comprise a lower portion sized and configured to be attached to a container; an aperture in the lower portion of the lid sized and configured to provide fluid communication with an attached container; an upper portion pivotally coupled to the lower portion, the upper portion movable between an open position to allow one or more fluids to exit the attached container through the aperture and a closed position to prevent the one or more fluids from exiting the attached container through the aperture; and a locking member coupled to the upper portion of the lid, the locking member slidable between a locked and an unlocked position. When the locking member is in the locked position, the upper portion of the lid may be pivotally coupled to the lower portion of the lid. When the locking member is in the unlocked position, the upper portion of the lid may not be coupled to the lower portion of the lid.

Still another aspect is the lid may include a flexible member coupled to the locking member and the lower portion of the lid, the flexible member may bias the upper portion of the lid into the closed position. In particular, a first portion of the flexible member may be disposed in a guide in the lower portion of the lid and, when the locking member slides between the locked and the unlocked position, the first portion of the flexible member moves within the guide. Additionally, a first portion of the flexible member may be disposed in a guide in the lower portion of the lid, a second portion of the flexible member may be disposed in a receiving portion in a lower portion of the locking member; and the flexible member may be disposed between the locking member and the lower portion of the lid. Further, the locking member may be slidably connected to a bottom surface of the upper portion of the lid; one or more receiving portions of the locking member may be aligned with one or more receiving portions of the upper portion of the lid when the locking member is in the unlocked position; and the one or more receiving portions of the locking member may not be aligned with the one or more receiving portions of the upper portion of the lid when the locking member is in the locked position. In addition, a sidewall may extend around a perimeter of the lower portion of the lid and an opening in the sidewall beneath a gripping portion of the locking member may allow a digit of a user to be inserted to move the locking member between the locked and the unlocked positions. When the locking member is in the locked position, one or more engaging portions of the lower portion of the lid may be disposed in one or more receiving portions of the upper portion of the lid and one or more receiving portions of the locking member; and one or more flanges of the locking member abut the one or more engaging portions to lock the one or more engaging portions into the one or more receiving portions. The one or more engaging portions may form a pivot point around which the upper portion of the lid pivots between the closed and the open positions.

Yet another aspect is a lid that may be sized and configured to be attached to a container, and the container may be sized and configured to be filled with a fluid. The lid may include a lower portion; a spout extending upwardly from an upper surface of the lower portion; an upper portion coupled to the lower portion, the upper portion movable between a closed position in which the upper portion covers the spout and an open position in which the upper portion does not cover the spout; and a locking member coupled to a bottom surface of the upper portion, the locking member may be slidable between a locked and an unlocked position, and the upper portion may be pivotally coupled to the lower portion when the locking member is in the locked position.

Still yet another aspect is a lid may include a flexible member disposed between the locking member and the lower portion of the lid, and the flexible member may bias the upper portion of the lid into the closed position. For example, the flexible member may be coupled to the locking member in a fixed position and the flexible member may be slidable within a receiving portion in the lower portion of the lid. If desired, a first portion of the flexible member may be disposed in a guide in the lower portion of the lid; a second portion of the flexible member may be connected to a lower surface of the locking member; and when the locking member slides between the locked and the unlocked position, the flexible member may move within the guide. In one exemplary embodiment, the guide may have a generally V-shaped groove that extends downwardly into the lower portion of the lid. Additionally, the locking member may be slidably connected to a bottom surface of the upper portion of the lid; one or more receiving portions of the locking member may be aligned with one or more receiving portions of the upper portion of the lid when the locking member is in the unlocked position; and one or more receiving portions of the locking member may not be aligned with the one or more receiving portions of the upper portion of the lid when the locking member is in the locked position. A sidewall may extend around a perimeter of the lower portion of the lid and the sidewall may include an aperture beneath a gripping portion of the locking member where a digit of a user may be inserted to move the locking member between the open and the closed positions. In addition, a first support wall and a second support wall may extend upwardly from a central wall of the lower portion of the lid; and a first engaging portion may be disposed on an inner surface of the first support wall and a second engaging portion may be disposed on an inner surface of the second support wall, the locking member and the upper portion of the lid pivotally may be coupled to the first and second engaging portions when the locking member is in the locked position. Further, the locking member may lock the first engaging portion in a first receiving portion of the locking member and a first receiving of the upper portion of the lid; and the locking member may lock the second engaging portion in a second receiving portion of the locking member and a second receiving of the upper portion of the lid.

A further aspect is a lid may be sized and configured to be attached to a container, and the container sized and configured to be filled with a fluid. The lid may comprise a lower portion; a spout extending upwardly from an upper surface of the lower portion; an upper portion pivotally coupled to the lower portion, the upper portion movable between an open position and a closed position, the upper portion covering the spout when the upper portion is in the closed position, the upper portion uncovering the spout when the upper portion is in the open position; a locking member coupled to the upper portion, the locking member movable between a locked position and an unlocked position; and a flexible member disposed between the locking member and the lower portion of the lid, the flexible member biasing the upper portion of the lid into the closed position. A portion of the flexible member may extend downwardly relative to the locking member and the upper portion of the lid, the flexible member may contact the lower portion of the lid, and the flexible member may be at least partially compressed when the upper portion of the lid is in the open position.

These and other aspects, features, and advantages of the present invention will become more fully apparent from the following brief description of the drawings, the drawings, the detailed description of preferred embodiments, and appended claims.

BRIEF DESCRIPTION OF THE DRAWINGS

The appended drawings contain figures of preferred embodiments to further illustrate and clarify the above and other aspects, advantages, and features of the present invention. It will be appreciated that these drawings depict only preferred embodiments of the invention and are not intended to limit its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF THE PREFERRED EMBODIMENTS

The present invention is generally directed towards a lid for a container. The principles of the present invention, however, are not limited to lids for containers. It will be understood that, in light of the present disclosure, the lids and containers disclosed herein may have a variety of shapes, sizes, configurations, and arrangements. It will also be understood that lids and containers may include any suitable number and combination of features, components, aspects, and the like. In addition, while the lids and containers shown in the accompanying figures are illustrated as having particular styles and configurations, it will be appreciated that the lids and containers may have any suitable style or configuration. Further, the lids and containers disclosed herein may be successfully used in connection with other types of objects and devices.

Additionally, to assist in the description of various exemplary embodiments of the lids and containers, words such as top, bottom, front, rear, sides, right, and left are used to describe the accompanying figures which may be, but are not necessarily, drawn to scale. It will be further appreciated that the lids and containers may be disposed in a variety of desired positions or orientations, and used in numerous locations, environments, and arrangements.

Briefly, a lid may be sized and configured to be attached to a container, and the container may be sized and configured to be filled with one or more fluids. The lid may include a lower portion, an upper portion, and a locking member. The locking member may be coupled to the upper portion of the lid and the locking member may be movable between locked and unlocked positions. When the locking member is in the locked position, the upper portion of the lid may be pivotally coupled to the lower portion of the lid and movable between open and closed positions. A flexible or biasing member may bias the lid into the closed position. A detailed description of exemplary embodiments of the lid and container system now follows.

Please note that exemplary embodiments are disclosed and described in detail below. It will be understood that different embodiments may have different parts, components, features and aspects; and the different parts, components, features and aspects may not be required. Further, it will be understood that different embodiments may include various combinations of these parts, components, features and aspects depending, for example, upon the intended use of the system.

Figure 1A:
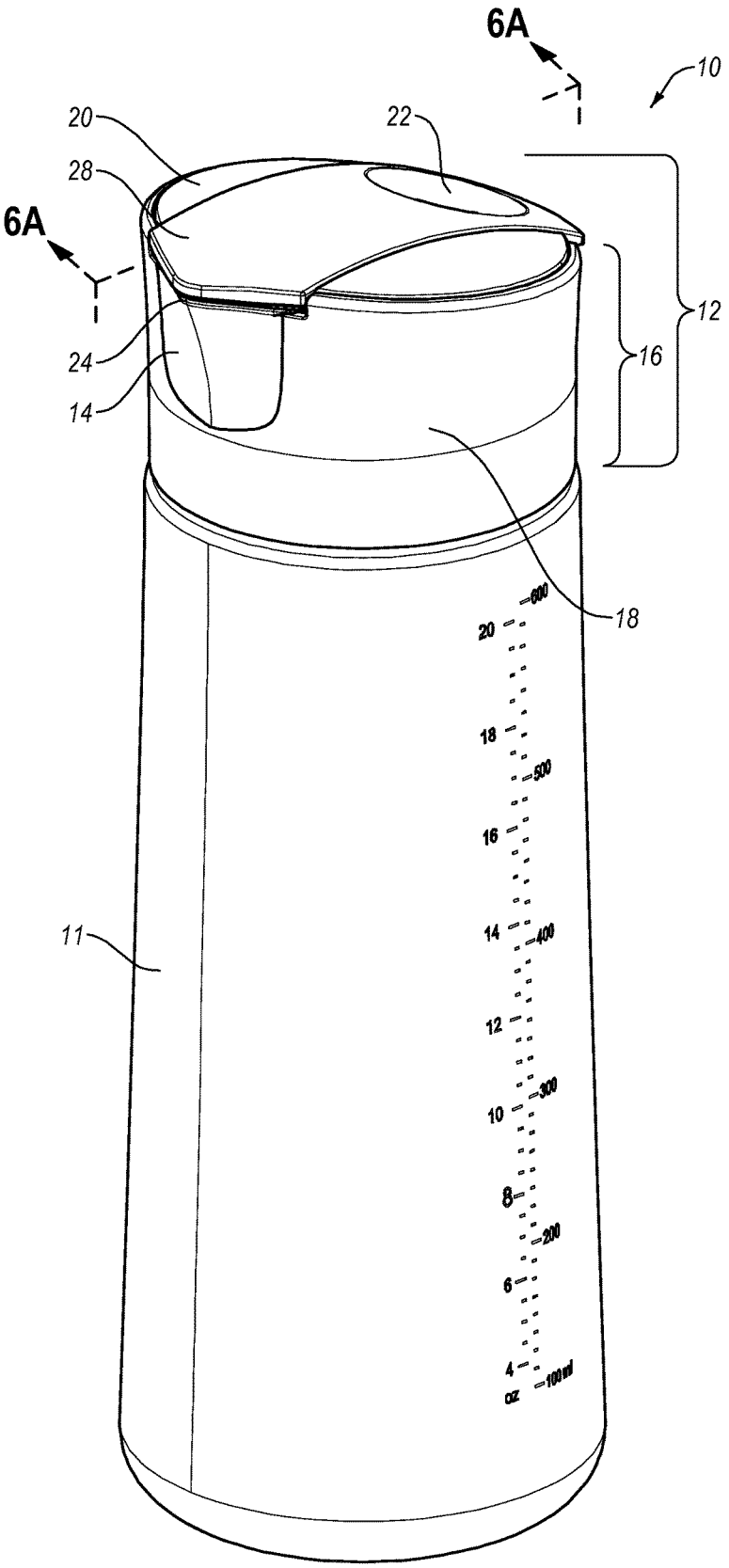
FIG. 1A is a perspective view of an exemplary container and lid, illustrating the lid in a closed position.
Figure 1B:
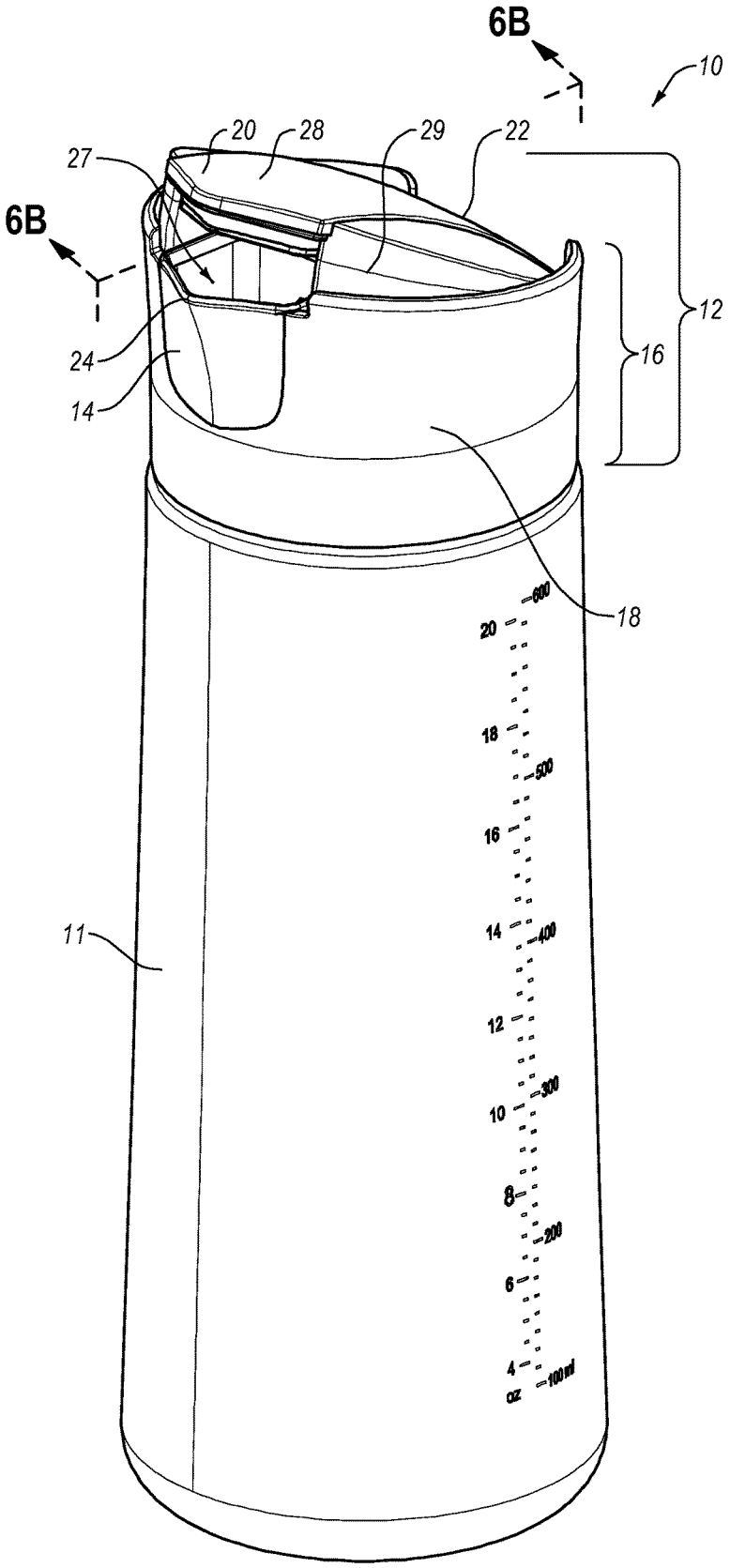
FIG. 1B is another perspective view of an exemplary container and lid, illustrating the lid in an open position.

As illustrated in FIGS. 1A and 1B, an exemplary embodiment of a lid system 10 may include a container 11 and a lid 12. The lid 12 may include a spout 14 and the spout may be disposed in a lower portion 16 of the lid 12. The spout 14 may be at least partially disposed in an outer sidewall 18 of the lower portion 16 of the lid 12. The lower portion 16 of the lid 12 may be selectively attached to the container 11 and the lid may include an upper portion 20 that is selectively attached to the lower portion.

The upper portion 20 may act as a closure or cover that selectively allows or prevents fluid from exiting the container 11 through the spout 14. When the upper portion 20 is in a closed position, as illustrated in FIG. 1A, the upper portion may cover the spout 14, preventing fluid from exiting the container. In greater detail, the spout 14 may include a lip 24 and the upper portion 20 of the lid 12 may contact, engage or abut the lip to prevent fluid from exiting the container 11. Specifically, a part of the upper portion 20 of the lid 12, such as a section 26, may have a shape generally corresponding to the lip 24 of the spout 14, such that when the upper portion is in the closed position, the section contacts, engages or abuts the lip to prevent the contents from spilling or leaking.

A user may apply a downward force to a rear portion 22 of the upper portion 20 of the lid 12, preferably opposite the spout 14, which may move the upper portion to the open position illustrated in FIG. 1B. In further detail, when the user applies the downward force to the rear portion 22, the upper portion 20 may act as a lever and may pivot around one or more pivot points to move between the closed position illustrated in FIG. 1A and the open position illustrated in FIG. 1B.

As illustrated in FIG. 1B, when the upper portion 20 is in the open position, the spout 14 may be uncovered and contents may be poured from the container 11. Thus, the spout 14 may provide an opening 27 to the container 11. A force on a front portion 28 of the upper portion 20 may move the upper portion to the closed position. As will later be described in further detail, if the lid 12 includes a flexible or biasing member, the user may not need to apply a force to close the lid.

One or more sidewalls 29 may extend generally downwardly from the upper portion 20 of the lid 12. The sidewalls 29 may have a generally circular configuration and may be generally aligned with the sidewall 18 of the lower portion 16 of the lid 12. In particular, at least a portion of the sidewalls 29 of the upper portion 20 of the lid 12 may be disposed inside the sidewall 18 of the lower portion 16, which may help create a lid with pleasing aesthetics.

Figure 2:
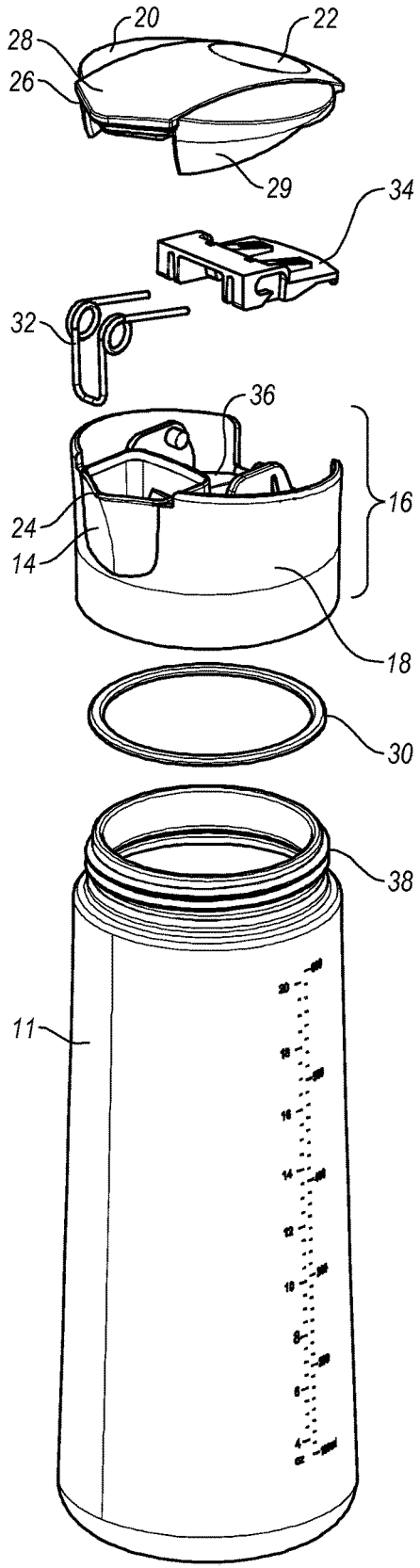
FIG. 2 is an exploded perspective view of the container and lid shown in FIG. 1.

As illustrated in FIG. 2, the lid system 10 may also include a seal or gasket 30, a flexible member 32, and a locking member 34. The gasket 30 may be disposed between the container 11 and the lower portion 16 of the lid 12, and the flexible member 32 may be disposed between the lower and upper portions 16, 20 of the lid 12. In greater detail, the locking member 34 may be disposed between the lower and upper portions 16, 20 of the lid 12, and the flexible member 32 may be disposed between the locking member and the lower portion of the lid.

The upper portion 20 and the lower portion 16 of the lid 12 may help control the flow of contents from the container 11. In particular, the spout 14 may extend generally upward from a central wall 36 of the lower portion 16 of the lid. As illustrated in greater detail in FIGS. 5A and 5B, the central wall 36 may act as a barrier that prevents contents in the container 11 from contacting the flexible member 32 or the locking member 34 when dispensing the contents through the spout 14. The central wall 36 may also act as a barrier that limits contents to exiting the container through the spout 14.

The upper portion 20 may be in the closed position when contents of the container 11 are stirred, mixed, blended, and/or shaken. When the upper portion 20 is in the closed position, the upper portion may cover the spout 14 and prevent the contents from exiting the container through the spout. With the upper portion 20 covering the spout 14 and the central wall 36 acting as a barrier over a remaining portion of the opening of the container 11, the contents may be sealed in the container and the lid 12 may provide a fluid-tight seal. Because the lower surface of the central wall 36 may be generally smooth and free from any grooves or crevices, the lower portion 16 of the lid 12 may be relatively easy to clean.

An end of the flexible member 32 may be coupled and/or integrally formed with the locking member 34. The flexible member 32 may extend generally downwardly from the locking member 34 at an angle and a portion of the flexible member may be disposed in a receiving portion or guide, which may be disposed on the central wall 36 of the lower portion 16. The flexible member 32 may flex, bend, and/or compress when the lid is opened by applying a force to the rear portion 22 of the upper portion 20. In particular, the force may compress the flexible member 32 and, when the force is removed, the flexible member may resiliently decompress or return to its former shape and/or length, which may automatically close the lid.

The locking member 34 may allow the upper portion 20 to be selectively coupled to the lower portion 16. When the locking member 34 is in the locked position, the upper portion 20 may be pivotally coupled to the lower portion 16, and the upper portion 20 may be movable between the open and closed positions. When the locking member 34 is in the unlocked position, the upper portion 20 of the lid 12 may be uncoupled and easily removed from the lower portion 16 of the lid.

The lower portion 16 may be sized and configured to be attached to the container 11. In particular, the lower portion 16 may be selectively attached to the container 11 by one or more threads 38. This may allow the lid 12 to be detached from the container 11 by unscrewing the lower portion 16 from the container 11, and this may allow the container to be easily filled with fluids such as dressings, powdered drinks, and the like.

The lid system 10 may be constructed from durable, long-lasting materials. The lid system 10 may also be constructed from materials that allow it to be reused and/or recycled. The container 11 and/or the lid 12 may, for example, be constructed from a relatively rigid material such as plastic. In particular, the container 11 and/or the lid 12 may be constructed from materials such as high-density polyethylene ("HDPE") or other materials with similar properties and/or characteristics. In view of this disclosure, one of ordinary skill in the art will appreciate that the lid system 10 and its various parts, such as the container 11 and/or the lid 12, may be constructed from various materials with desired properties such as different types of plastics, glass, metal, composites and the like. Additionally, the container 11 and/or the lid 12 may be constructed from at least partially transparent or translucent materials, which may allow the user to see the type and amount of fluids in the container. Further, the flexible member 32 may be constructed from a relatively durable material that is flexible, resilient, and/or spring-like to allow the flexible member to be resiliently deformed. The flexible member 32 may be constructed from, for example, plastic and/or steel. As illustrated in FIG. 2, the flexible member 32 may be constructed from a wire. For instance, the wire may include a first portion or end that extends in a generally straight line, a generally circular, loop-shaped body portion, and a second portion or end with a generally V-shaped configuration. The ends and body portion may be sized and configured to allow the flexible member 32 to be compressed or deform when the lid 12 is opened, and the flexible member may be sized and configured to help close the lid. The flexible member 32 may also be sized and configured to bias the lid 12 into the closed position. It will be appreciated, after reviewing this disclosure that the flexible member 32 may also be bent or shaped to include one or more angled portions, and the flexible member may have other suitable shapes, sizes, configurations and arrangements depending, for example, upon the intended use of the lid system 10.

Figure 3B:
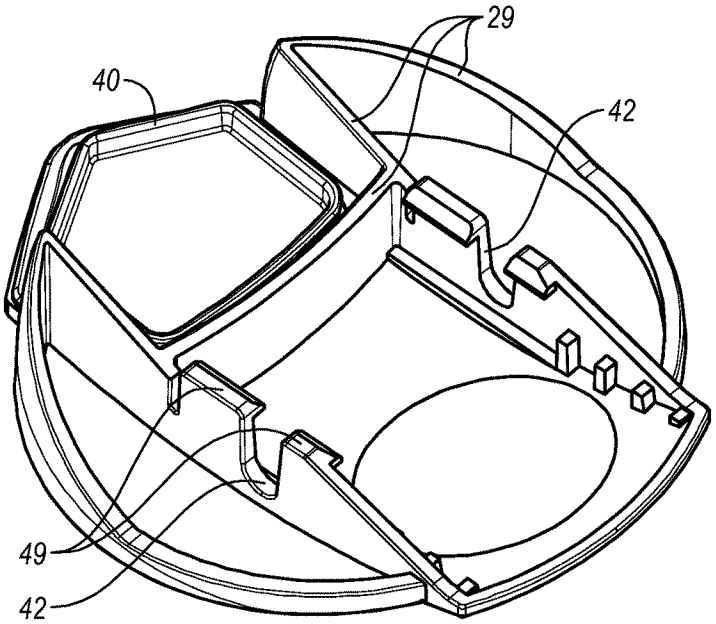
FIG. 3B is an enlarged lower perspective view of the lid.
Figure 3A:
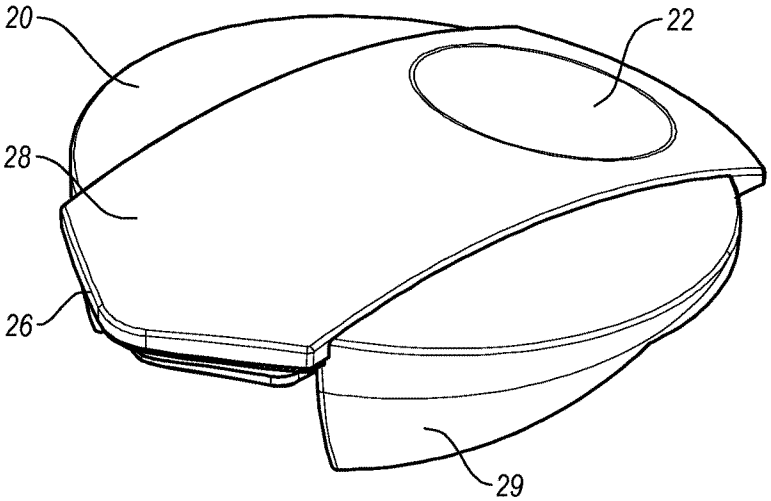
FIG. 3A is an enlarged upper perspective view of the lid.

As illustrated in FIG. 3A, the upper portion 20 may include a slightly curved or rounded upper surface. If a user desires to dispense contents from the container, the user may press down on the rear portion 22 of the upper surface of the upper portion 20 using his or her thumb or finger. The rear portion 22 may include a depression, curved area, or other indicator to indicate where a force should be applied. The force may cause the upper portion 20 to pivot around one or more pivot points and move from a closed position to an open position. If the user desires to prevent the contents from exiting the container 11, such as when mixing the contents, the user may simply lift his or her finger or thumb from the rear portion 22, and the flexible member 32 may automatically return the upper portion 20 to the closed position.

As illustrated in FIG. 3B, a bottom portion of the upper portion 20 may include a downwardly extending projection, such as a ridge 40, and the ridge may be set back or spaced apart from the rim 26 or outer periphery of the upper portion 20 of the lid 12. The ridge 40 may fit inside the spout 14 when the upper portion 20 is in the closed position. In particular, the ridge 40 may contact, abut and/or engage an inner circumference or portion of the spout 14 to help secure contents inside the container and prevent leakage. Advantageously, the ridge 40 may help create a consistent, reliable seal around the spout 14.

Figure 4B:
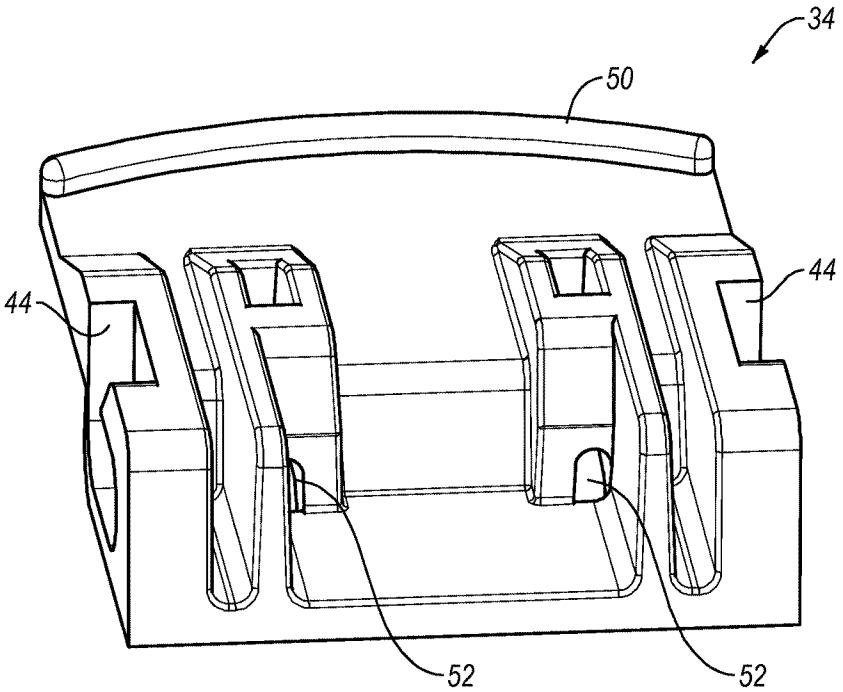
FIG. 4B is an enlarged lower perspective view of the locking member.
Figure 4A:
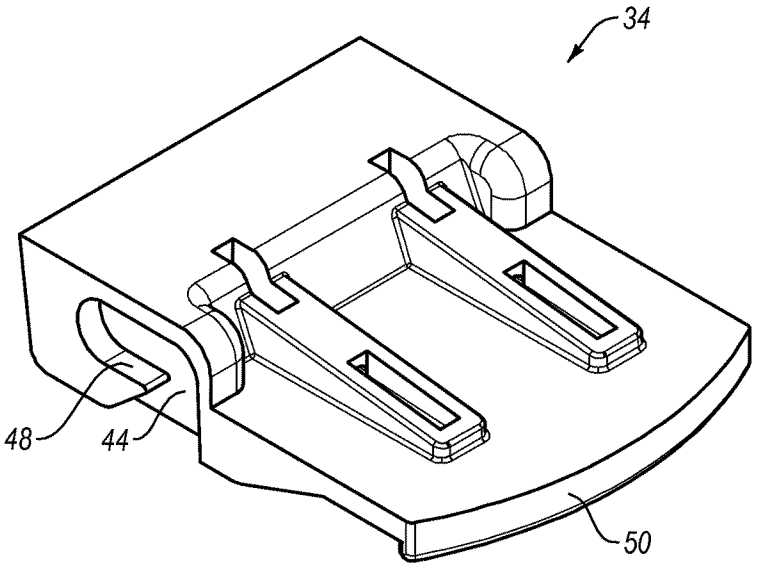
FIG. 4A is an enlarged upper perspective view of a locking member.
Figure 5B:
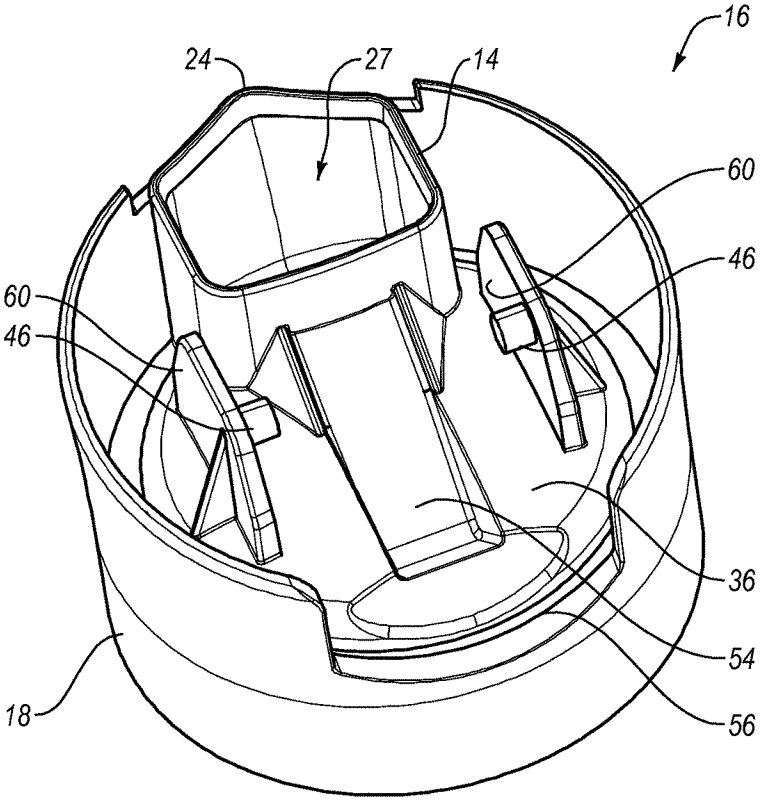
FIG. 5B is an enlarged rear, upper perspective view of a lower portion of the lid.
Figure 5A:
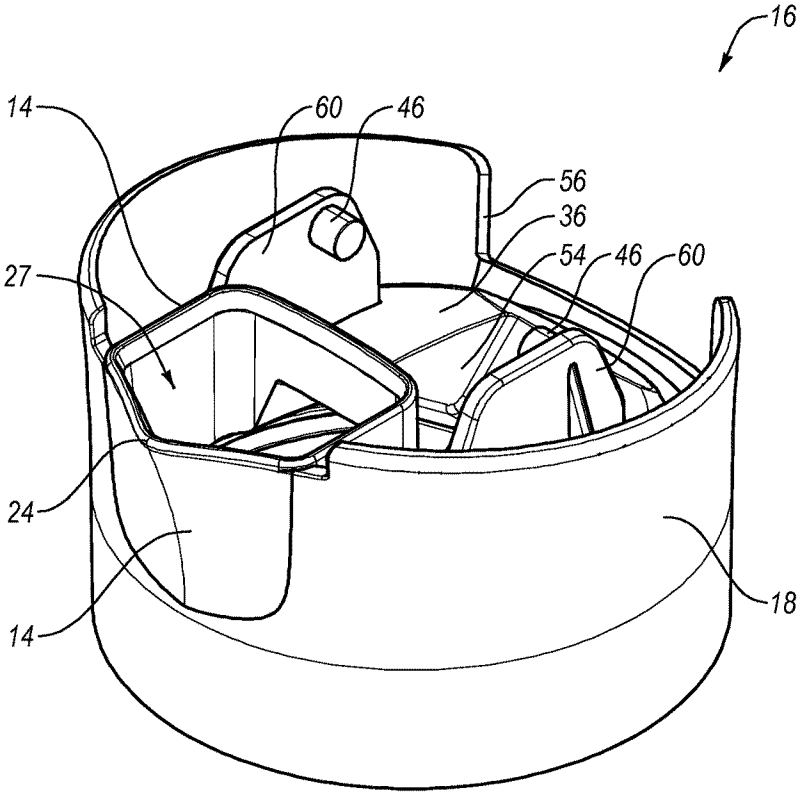
FIG. 5A is an enlarged front, upper perspective view of a lower portion of the lid.

As illustrated in FIG. 3B, the upper portion 20 of the lid 12 may include two receiving portions 42, such as slots. As illustrated in FIGS. 4A and 4B, the locking member 34 may include two receiving portions 44, such as grooves. As illustrated in FIGS. 5A and 5B, the lower portion 16 of the lid 12 may include two engaging portions 46, such as pins or protrusions. The engaging portions 46 may be disposed in the receiving portions 42 of the upper portion 20 and the receiving portions 44 of the locking member 34. In particular, the engaging portions 46, such as the protrusions, may extend inwardly through the receiving portions 42, such as slots, of the upper portion 20 and into the receiving portions 44, such as the grooves, of the locking member 34. When the engaging portions 46 of the lower portion 16 are disposed in the receiving portions 42, 44 of both the upper portion 20 and the locking member 34, the locking member 34 may be moved to a locked position that locks the engaging portions of the lower portion 16 in the receiving portions of both the upper portion 20 and the locking member 34. In greater detail, when the engaging portions 46 are disposed in both the receiving portions 42 of the upper portion 20 and the receiving portions 44 of the locking member 34, the locking member may be slid into the locked position. In addition, the receiving portions 44 of the locking member 34 may include flanges 48 that helps lock the engaging portions 46 in the receiving portions 42, 44. The flanges 48, for instance, may abut the engaging portions 46 to help lock the engaging portions into the receiving portions 44.

When the locking member 34 is in the locked position, the engaging portions 46 may act as or form pivot points around which the upper portion 20 of the lid 12 may pivot between the open and closed positions. For example, the engaging portions 46, such as protrusions, may act as pivot points for the upper portion 20 when the engaging portions are disposed in the receiving portions 42, 44, such as slots and grooves.

The locking member 34 may be coupled to a lower surface of the upper portion 20 in a manner that allows the locking member to slide with respect to the upper portion. For example, the locking member 34 may be coupled to the lower surface of the upper portion 20 of the lid 12 by disposing the locking member within a receiving portion and the locking member may be disposed into the receiving portion by a snap fit or other suitable connection. As illustrated in FIG. 3B, one or more protrusions 49 may help couple the locking member 34 to the upper portion 20 of the lid 12.

When the locking member 34 is in the locked position, the upper portion 20 of the lid 12 may be pivotally coupled to the lower portion 16 of the lid 12, and the upper portion 20 may be movable between the open and closed positions. When the locking member 34 is in the unlocked position, the upper portion 20 may be uncoupled and removed from the lower portion 16, if desired.

As illustrated in FIGS. 4A and 4B, the locking member 34 may include one or more gripping portions 50, such as flanges, protrusions, grooves, and the like, which may facilitate gripping of the locking member and movement of the locking member between the locked and unlocked positions. The flexible member 32 may be coupled to the locking member 34 by inserting a portion of the flexible member into an opening 52 in the locking member. For example, the flexible member 32 may be constructed from a resilient material, such as metal, and may be in the form of a wire. Thus, the opening 52 in the locking member 34 may be sized and fitted to receive an end of the flexible member 32. The opening 52 may be elongated and extend generally parallel to a body of the locking member 34. The end of the flexible member 32 inserted into the opening 52 and the opening may have corresponding shapes and sizes to allow the flexible member to be securely connected to the locking member 34. The loop-shaped portion of the flexible member 32 may be disposed at least proximate the locking member 34 and the angled portion of the flexible member may be disposed an at angle between about 45° and about 90° relative to the locking member. In addition, the angled portion may be disposed at an angle between about 60° and about 90° relative to the locking member 34. The angled portion may have a generally V-shaped or U-shaped configuration.

A receiving portion, such as a guide 54, which is illustrated in FIGS. 5A and 5B, may receive a portion of the flexible member 32. For example, the guide 54 may receive the angled portion of the flexible member when the upper portion 20 is connected to the lower portion 16 of the lid 12. The guide 54 may be located on the upper surface of the central wall 36 of the lower portion 16. As will be explained in further detail with respect to FIGS. 6A and 6B, a portion of the flexible member 32 may be disposed in and move within the guide 54 when the locking member 34 moves between a locked and unlocked position.

As illustrated in FIGS. 5A and 5B, a portion of the outer sidewall 18 of the lower portion 16 may extend generally upwardly from the central wall 36 of the lower portion 16 and an aperture 56 may allow a user to insert his or her digit or digits into the lid 12 and grip the gripping portion 50 of the locking member 34. The aperture 56 may be disposed generally beneath the gripping portion 50 of the locking member 34. The width of the aperture 56 may, for example, be approximately the same as the width of the locking member 34, though in some embodiments, it may be wider or narrower. The user may insert his or her digit or digits into the aperture 56 and move the locking member 34 to the locked position by moving the locking member 34 in a first direction. The user may move the gripping portion 50 in an opposite direction to move the locking member 34 to the unlocked position. For example, the user may insert his or her digit or digits into the aperture 56 and move the locking member 34 to the locked position by pulling the gripping portion 50 of the locking member 34 away from the spout 14. The user may insert his or her digit or digits into the aperture 56 and move the locking member 34 to the unlocked position by pushing the gripping portion 50 of the locking member towards the spout 14.

As illustrated in FIGS. 5A and 5B, the lower portion 16 of the lid may include one or more support walls 60. The support walls 60 may be disposed within a circumference, outer perimeter and/or sidewall 18 of the lower portion 16 of the lid 12. The support walls 60 may extend upwardly from an upper surface of the central wall 36 of the lower portion 16 and the height of the support walls 60 may be approximately equal to a height of the sidewall 18. The support walls 60 may be sized and configured to support the upper portion 20 of the lid 12. In greater detail, the support walls 60 may be disposed in a generally parallel relationship and generally perpendicular to the upper surface of the central wall 36. The engaging portions 46 may be disposed on opposing surfaces of the support walls 60 and the engaging portions may be disposed directly across from each other on the inner surfaces of the support walls 60. The upper portion 20 of the lid 12 may pivot about an axis of rotation that is generally aligned with the engaging portions 46. The engaging portions 46 may be disposed at a height approximately equal to a height of the spout 14, which may allow the upper portion 20 to lay substantially flat across the spout 14 when in a closed position.

Figure 6A:
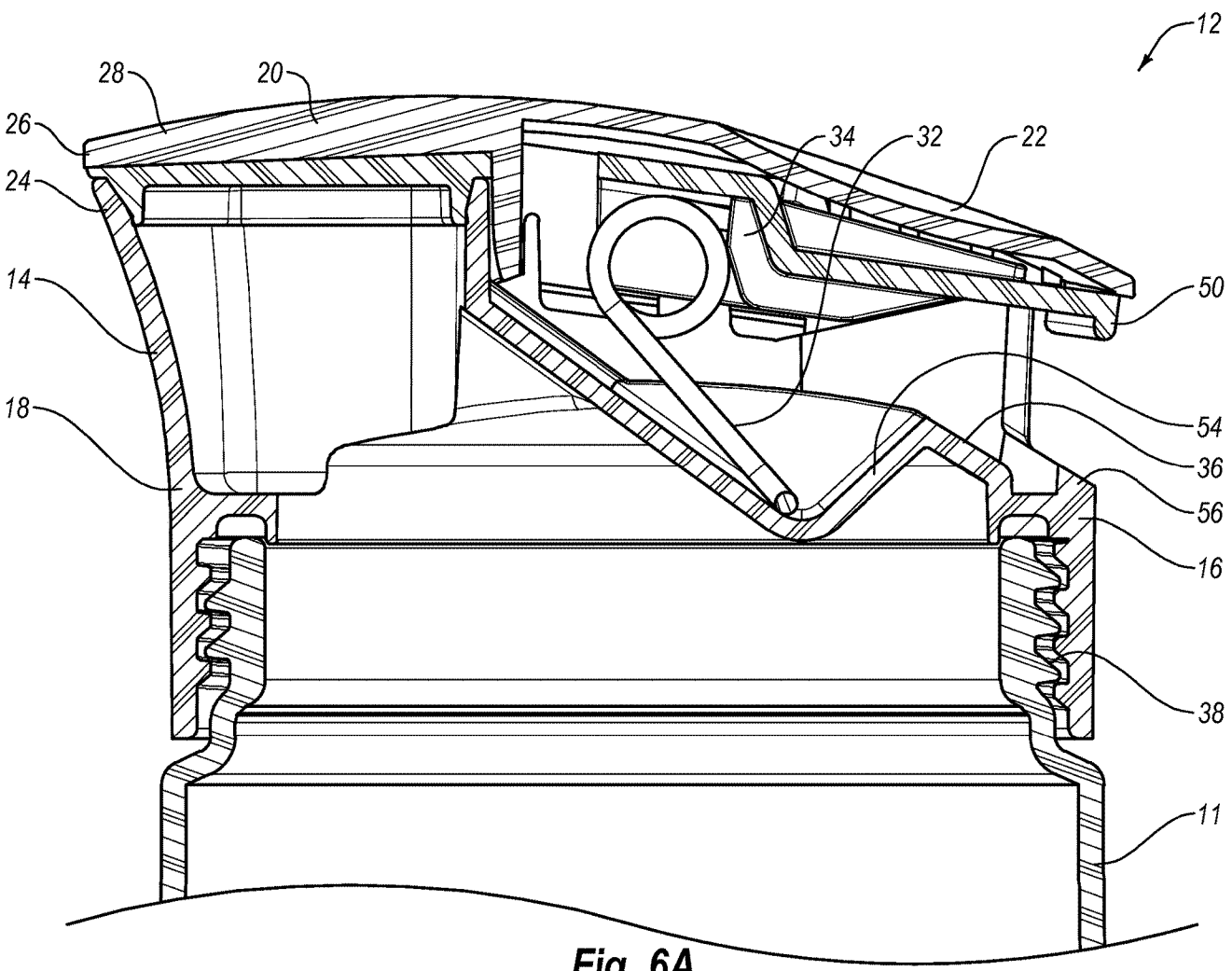
FIG. 6A is an enlarged cross-sectional side view of the lid and a portion of the container shown in FIG. 1 along lines 6A-6A.
Figure 6B:
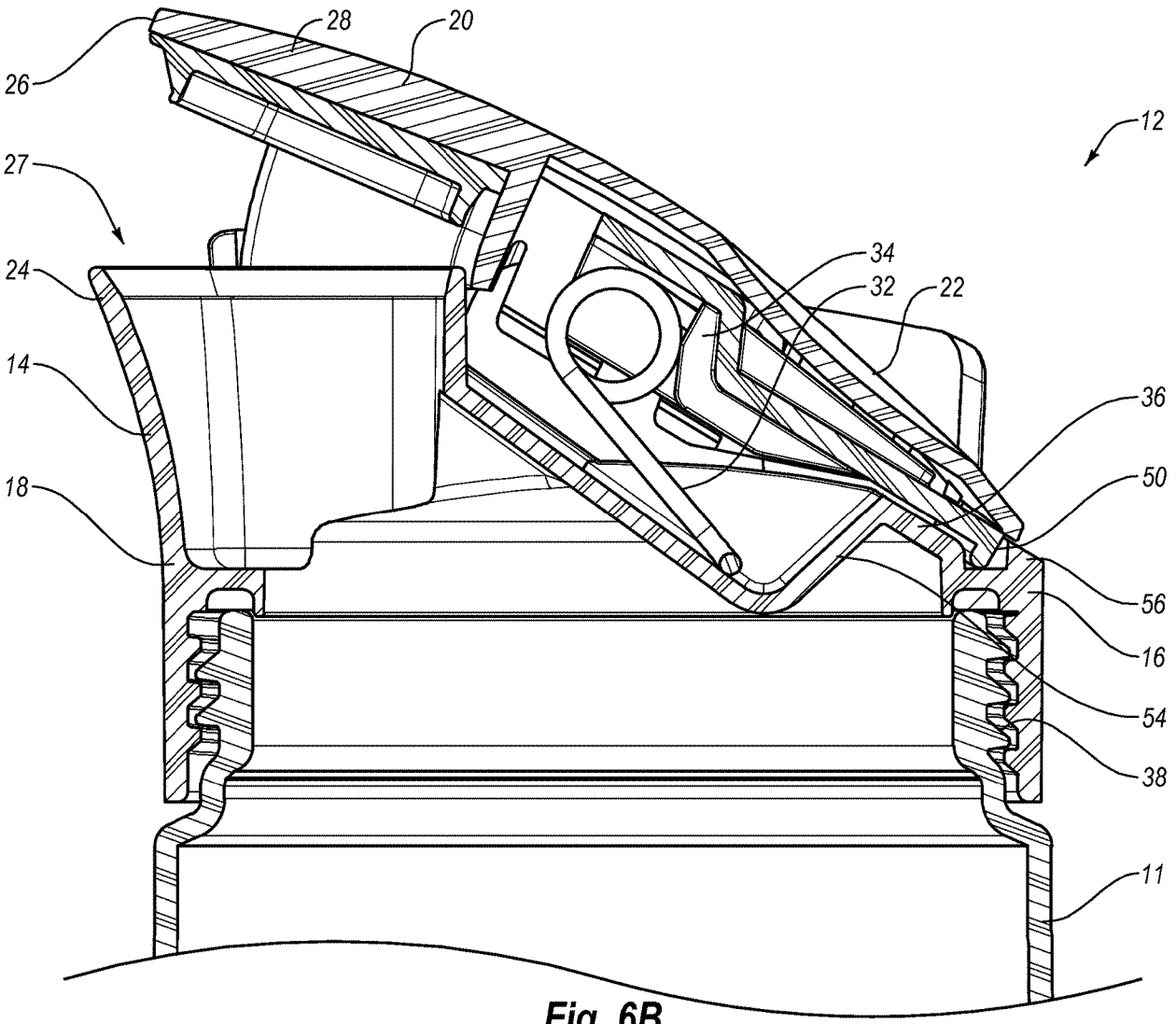
FIG. 6B is an enlarged cross-section side view of the lid and a portion of the container shown in FIG. 2 along lines 6B-6B.

As illustrated in FIGS. 6A and 6B, the flexible member 32 may be generally disposed between the lower and upper portions 16, 20 of the lid 12. As previously described, a first portion of the flexible member 32 may contact, engage or be coupled to the upper portion 20 of the lid 12 and a second portion of the flexible member 32 may contact, engage or be coupled to the lower portion 16 of the lid. As shown in the accompanying figures, the generally U-shaped or V-shaped portion of the flexible member 32 may be disposed in the guide 54 in the lower portion 16 of the lid 12. The flexible member 32 may flex, bend, and/or compress when a force is applied to the upper portion 20 and the upper portion may move into the open position. When the force is removed, the flexible member 32 may automatically move the upper portion 20 to a closed position. Thus, the flexible member 32 may bias the lid 12 into the closed position.

In operation, when the upper portion 20 is connected to the lower portion 16 of the lid 12, a user may press on the rear portion 22 to pivot the upper portion into the open position. This may allow the user to pour the contents of the container 11 out through the spout 14. When the user no longer presses on the upper portion 20, the lid 12 may automatically move into the closed position because the flexible member 32 may bias the lid into the closed position. If it is desired to disconnect the upper portion 20 from the lower portion 16 of the lid, the locking member 34 may be unlocked and the engaging portions 46 may be removed from the receiving portions 42, 44. This may facilitate cleaning of the lid 12. The upper portion 20 may be attached to the lower portion 16 of the lid 12 by inserting the engaging portions 46 into the receiving portions 42, 44, disposing a portion of the flexible member 32 in the opening 52 in the locking member 34 and another portion of the flexible member in the guide 54, and locking the locking member. If desired, the lid 12 may be connected or disconnected from the container 11 by, for example, a threaded connection.

Advantageously, the lid 12 may be simple to use and operate. In addition, because the lid 12 has few parts, the lid may be quickly and easily assembled, cleaned, and disassembled. Further, the parts may be efficiently manufactured and the lid 12 may be easily repaired and/or replaced.

The present invention may be embodied in other specific forms without departing from its spirit or essential characteristics. The described embodiments are to be considered in all respects as only illustrative and not restrictive. The scope of the invention is, therefore, indicated by the appended claims, rather than by the foregoing description. All changes which come within the meaning and range of equivalency of the claims are to be embraced within their scope.

What is claimed is:

1. A lid sized and configured to be attached to a container, the container sized and configured to be filled with one or more fluids, the lid comprising:

a lower portion, the lid being sized and configured to be attached to a container at the lower portion;

an aperture in the lower portion of the lid sized and configured to provide fluid communication with an attached container;

an upper portion of the lid coupled to the lower portion of the lid, the upper portion movable between an open position to allow one or more fluids to exit the attached container through the aperture and a closed position to prevent the one or more fluids from exiting the attached container through the aperture; and a locking member coupled to the upper portion of the lid, the locking member slidable between a locked and an unlocked position, one or more receiving portions of the locking member being aligned with one or more receiving portions of the upper portion of the lid when the locking member is in the unlocked position, and the one or more receiving portions of the locking member being not aligned with the one or more receiving portions of the upper portion of the lid when the locking member is in the locked position;

wherein when the upper portion of the lid is coupled to the lower portion of the lid, the locking member is in the locked position; and wherein when the locking member is in the unlocked position, the upper portion of the lid is not coupled to the lower portion of the lid.

2. The lid as in claim 1, further comprising a flexible member coupled to the locking member and contacting the lower portion of the lid, the flexible member biasing the upper portion of the lid into the closed position.

3. The lid as in claim 2, wherein a first portion of the flexible member is disposed in a receiving portion in the lower portion of the lid; and wherein when the locking member slides between the locked and the unlocked position, the first portion of the flexible member moves within the receiving portion in the lower portion of the lid.

4. The lid as in claim 2, wherein a first portion of the flexible member is disposed in a receiving portion in the lower portion of the lid;

wherein a second portion of the flexible member is disposed in a receiving portion in the locking member; and wherein the flexible member is disposed between the locking member and the lower portion of the lid.

5. The lid as in claim 1, wherein the locking member is slidably connected to a bottom surface of the upper portion of the lid.

6. The lid as in claim 1, further comprising a gripping portion of the locking member that facilitates movement of the locking member between the locked and unlocked positions; and a sidewall that extends around a perimeter of the lower portion of the lid and an opening in the sidewall beneath the gripping portion of the locking member where a digit of a user may be inserted to move the locking member between the locked and the unlocked positions.

7. The lid as in claim 1, wherein when the locking member is in the locked position and the upper and lower portions of the lid are coupled:

one or more engaging portions of the lower portion of the lid are disposed in the one or more receiving portions of the upper portion of the lid and in the one or more receiving portions of the locking member; and one or more flanges of the locking member abut the one or more engaging portions to lock the one or more engaging portions into the one or more receiving portions.

8. The lid as in claim 7, wherein each of the one or more engaging portions forms a pivot point around which the upper portion of the lid pivots between the closed and the open positions.

9. A lid sized and configured to be attached to a container, the container sized and configured to be filled with a fluid, the lid comprising:

a front;

a rear positioned opposite the front;

sides between the front and the rear;

a lower portion;

a spout at least partially disposed in the lower portion proximate the front;

an upper portion; and a locking member selectively coupling the upper and lower portions of the lid, the locking member slidable between a locked and an unlocked position, at least a portion of the locking member disposed proximate the rear of the lid in the locked position;

wherein when the upper and lower portions of the lid are coupled, the locking member is in the locked position, and the upper portion is movable about an axis between a closed position in which the upper portion covers the spout and an open position in which the upper portion does not cover the spout, the axis extending towards the sides; and wherein the locking member slides along a path extending forward and backward relative to the lid between the locked and unlocked positions.

10. The lid as in claim 9, further comprising a flexible member disposed between the upper portion of the lid and the lower portion of the lid, the flexible member biasing the upper portion of the lid into the closed position.

11. The lid as in claim 10, wherein the flexible member is coupled to the locking member in a fixed position and the flexible member is slidable within a receiving portion in the lower portion of the lid.

12. The lid as in claim 10, wherein the receiving portion in the lower portion of the lid comprises a guide, and a first portion of the flexible member is disposed in the guide in the lower portion of the lid;

wherein a second portion of the flexible member is connected to the locking member; and wherein when the locking member slides between the locked and the unlocked position, the flexible member moves within the guide.

13. The lid as in claim 9, wherein the locking member is slidably connected to the upper portion of the lid;

wherein one or more receiving portions of the locking member are aligned with one or more receiving portions of the upper portion of the lid when the locking member is in the unlocked position; and wherein the one or more receiving portions of the locking member are not aligned with the one or more receiving portions of the upper portion of the lid when the locking member is in the locked position.

14. The lid as in claim 9, further comprising a sidewall that extends along a perimeter of the lower portion, and an aperture between the upper and lower portions of the lid where a digit of a user may be inserted to move the locking member between the locked and the unlocked positions.

15. The lid as in claim 14, wherein the locking member includes a gripping portion extending into the aperture.

16. The lid as in claim 9, further comprising a first support wall and a second support wall extending upwardly from a central wall of the lower portion of the lid; and further comprising a first engaging portion disposed on an inner surface of the first support wall and a second engaging portion disposed on an inner surface of the second support wall, the locking member and the upper portion of the lid pivotally coupled to the first and second engaging portions when the locking member is in the locked position.

17. The lid as in claim 16, wherein the locking member locks the first engaging portion in a first receiving portion of the locking member and a first receiving portion of the upper portion of the lid; and wherein the locking member locks the second engaging portion in a second receiving portion of the locking member and a second receiving portion of the upper portion of the lid.

18. A lid sized and configured to be attached to a container, the container sized and configured to be filled with a fluid, the lid comprising:

a lower portion;

a spout at least partially disposed in the lower portion;

an upper portion pivotally coupled to the lower portion, the upper portion movable between an open position and a closed position, the upper portion covering the spout when the upper portion is in the closed position, the upper portion uncovering the spout when the upper portion is in the open position;

a locking member movable between a locked position and an unlocked position, the locking member coupled with the upper portion of the lid in each of the locked position and the unlocked position and while moving between the locked position and the unlocked position; and a flexible member disposed between the locking member and the lower portion of the lid, the flexible member biasing the upper portion of the lid into the closed position, wherein:

a first portion of the flexible member is disposed in a receiving portion in the lower portion of the lid; and the first portion of the flexible member is movable within the receiving portion in the lower portion of the lid responsive to movement of the locking member between the locked position and the unlocked position.

19. The lid as in claim 18, wherein a second portion of the flexible member extends downwardly relative to the locking member and the upper portion of the lid, the flexible member contacts the lower portion of the lid, and the flexible member is at least partially compressed when the upper portion of the lid is in the open position.

20. A lid sized and configured to be attached to a container, the container sized and configured to be filled with one or more fluids, the lid comprising:

a lower portion of the lid sized and configured to be attached to a container;

an opening in the lower portion of the lid sized and configured to provide fluid communication with an attached container;

an upper portion of the lid movable relative to the lower portion of the lid between an open position to allow one or more fluids to flow through the opening and a closed position to prevent the one or more fluids from flowing through the opening;

a locking member movable between a locked position and an unlocked position, the locking member coupling the upper portion and the lower portion of the lid in the locked position, the locking member allowing the upper portion and the lower portion of the lid to be decoupled in the unlocked position, the locking member movable along an axis aligned with a front portion and a rear portion of the lid between the locked and unlocked positions;

a gripping portion of the locking member that facilitates movement of the locking member between the locked and unlocked positions; and a sidewall that extends around a perimeter of the lower portion of the lid and an opening in the sidewall beneath the gripping portion of the locking member to facilitate a user moving the locking member between the locked and the unlocked positions.

21. The lid as in claim 20, wherein:

one or more receiving portions of the locking member are aligned with one or more receiving portions of the upper portion of the lid when the locking member is in the unlocked position; and the one or more receiving portions of the locking member are not aligned with the one or more receiving portions of the upper portion of the lid when the locking member is in the locked position.

22. The lid as in claim 21, wherein when the locking member is in the locked position and the upper and lower portions of the lid are coupled:

one or more engaging portions of the lower portion of the lid are disposed in the one or more receiving portions of the upper portion of the lid and in the one or more receiving portions of the locking member; and one or more flanges of the locking member abut the one or more engaging portions to lock the one or more engaging portions into the one or more receiving portions.

23. The lid as in claim 20, further comprising a flexible member coupled to the locking member and contacting the lower portion of the lid, wherein:

the flexible member is configured to bias the upper portion of the lid into the closed position;

the flexible member is disposed between the locking member and the lower portion of the lid.

24. The lid as in claim 23, wherein:

a first portion of the flexible member is disposed in a receiving portion in the lower portion of the lid;

a second portion of the flexible member is disposed in a receiving portion in the locking member; and when the locking member moves between the locked position and the unlocked position, the first portion of the flexible member moves within the receiving portion in the lower portion of the lid.

* * * * *